US011765513B2

(12) United States Patent
Liu

(10) Patent No.: US 11,765,513 B2
(45) Date of Patent: Sep. 19, 2023

(54) DUAL MAGNETIC CIRCUITS STRUCTURE AND SOUND DEVICE

(71) Applicant: AAC Microtech (Changzhou) Co., Ltd., Changzhou (CN)

(72) Inventor: Jiujian Liu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 57 days.

(21) Appl. No.: 17/549,720

(22) Filed: Dec. 13, 2021

(65) Prior Publication Data

US 2022/0210566 A1 Jun. 30, 2022

(30) Foreign Application Priority Data

Dec. 25, 2020 (CN) ..... 202011561107.5

(51) Int. Cl.
*H04R 9/02* (2006.01)
*H04R 9/04* (2006.01)
*H04R 9/06* (2006.01)

(52) U.S. Cl.
CPC ..... *H04R 9/025* (2013.01); *H04R 9/045* (2013.01); *H04R 9/046* (2013.01); *H04R 9/06* (2013.01)

(58) Field of Classification Search
CPC ..... H04R 9/022; H04R 9/063; H04R 9/00; H04R 9/025; H04R 9/046; H04R 2209/041; H04R 9/045; H04R 9/06; H04R 2209/026; H04R 1/1091; H04R 2460/13; H04R 7/16; H04R 9/041; H01F 7/121; H01F 7/081
USPC ..... 381/400, 401, 407, 17, 396, 398, 404, 381/412, 410
See application file for complete search history.

(56) References Cited

U.S. PATENT DOCUMENTS

2004/0156527 A1* 8/2004 Stiles ..... H04R 9/063 381/412
2008/0044044 A1* 2/2008 Madaffari ..... H04R 9/025 381/186
2012/0163651 A1* 6/2012 Zhang ..... H04R 9/025 381/407
2018/0288529 A1* 10/2018 Sancisi ..... H04R 7/18
2020/0092654 A1* 3/2020 Lilienthal ..... H04R 9/045

* cited by examiner

*Primary Examiner* — Carolyn R Edwards
*Assistant Examiner* — Julie X Dang
(74) *Attorney, Agent, or Firm* — W&G Law Group

(57) ABSTRACT

The present disclosure provides a dual magnetic circuits structure and a sound device, the dual magnetic circuits structure includes a shell and an inner magnetic assembly, the shell is made of a magnetically permeable material, the inner magnetic assembly is arranged in the shell and includes a first inner magnetic element and a second inner magnetic element, a first magnetic gap, a second magnetic gap, an outer diameter of the second inner magnetic element is greater than that of the first inner magnetic element. Therefore, compared to the existing dual magnetic circuits structure, the dual magnetic circuits structure provided by the present invention has the advantage that the thickness of the whole dual magnetic path structure can be effectively reduced while ensuring that the vibration spaces and winding heights of the first voice coil and the second voice coil are not changed.

8 Claims, 6 Drawing Sheets

DUAL MAGNETIC CIRCUITS STRUCTURE AND SOUND DEVICE

TECHNICAL FIELD

The present invention relates to the technical field of electroacoustic conversion, in particular to a dual magnetic circuits structure and a sound device.

BACKGROUND ART

Compared with direct use of two speakers, a speaker with an opposite vertex dual magnetic circuits structure can reduce consumables and reduce the cost while ensuring the same loudness since partial materials are shared. Furthermore, the opposite vertex dual magnetic circuits structure can also counteract the vibration and improve the performance of the speaker. FIG. 1 shows a schematic structural diagram of cooperation among the existing opposite vertex dual magnetic circuits structure and a first voice coil as well as a second voice coil, wherein the first voice coil 110' and the second voice coil 120' are arranged in a magnetic gap 10' of the opposite vertex dual magnetic circuits structure 300'. FIG. 2 is a distribution diagram of magnetic lines of the existing opposite vertex dual magnetic circuits structure. Because of the limitation of the existing opposite vertex dual magnetic circuits structure 300', the speaker is relatively thick, so it is no longer applicable in scenarios where there is a strict requirement for the thickness of the speaker.

Therefore, it is necessary to provide a new dual magnetic circuits structure to solve the above-mentioned problems.

SUMMARY

The first purpose of the present invention is to provide a dual magnetic circuits structure, so as to solve the technical problem that the thickness of a speaker cannot be reduced due to the design limitation of the existing dual magnetic circuits structure.

The second purpose of the present invention is to provide a sound device.

The technical solution provided by the first embodiment of the present invention is as follows: a dual magnetic circuits structure comprises a shell and an inner magnetic assembly; the shell is made of a magnetically permeable material; the inner magnetic assembly is arranged in the shell;

The inner magnetic assembly comprises a first inner magnetic element and a second inner magnetic element which are stacked up; wherein a first magnetic gap configured for disposing a first voice coil and a part of a second voice coil is formed in a gap between a circumference of the first inner magnetic element and the shell; a second magnetic gap configured for disposing the other part of the second voice coil is formed in a gap between the circumference of the second inner magnetic element and the shell in a spacing manner; the second inner magnetic element has an outer diameter greater than that of the first inner magnetic element so that vibration paths of the first voice coil and the second voice coil are staggered from each other in directions parallel to a vibration direction of the first voice coil.

Further, the first inner magnetic element comprises a first main magnet, a first main pole plate, and a second main magnet which are stacked up in sequence; the first magnetic gap is formed between the circumference of the first main magnet, the circumference of the first main pole plate as well as the circumference of the second main magnet and the shell form;

the second inner magnetic element comprises a second main pole plate and a third main magnet; the second main pole plate is arranged between the second main magnet and the third main magnet; the second main pole plate has an outer diameter greater than that of the first main pole plate; the second magnetic gap is formed between the circumference of the second main pole plate as well as the circumference of the third main magnet and the shell; and the first magnetic gap and the second magnetic gap communicate with each other.

Further, the shell comprises an upper shell, a lower shell opposite to the upper shell, and a annular shell for connecting the upper shell with the lower shell; the upper shell is arranged on a side of the first main magnet away from the first main pole plate; the lower shell is arranged on a side of the third main magnet away from the second main pole plate; and the annular shell surrounds the first main pole plate.

Further, a first auxiliary magnet is clamped between the upper shell and the annular shell; the first auxiliary magnet circumferentially surrounds the first main magnet; a second auxiliary magnet is clamped between the annular shell and the lower shell; and the second auxiliary magnet circumferentially surrounds the second main magnet.

Further, an end part of the upper shell close to the annular shell extends towards a direction away from the first magnetic gap to form a first extending part; two end parts of the annular shell extend towards the direction away from the first magnetic gap to form two second extending parts; an end part of the lower shell close to the annular shell extends towards a direction close to the first magnetic gap to form a third extending part;

the first auxiliary magnet is clamped between the first extending part and one of the second extending parts, and the second auxiliary magnet is clamped between the third extending part and the other second extending part.

Further, the upper shell comprises a first bottom wall which covers the first main magnet, and a first side wall which extends in a bent manner from a circumferential edge of the first bottom wall towards the second inner magnetic element; and the first extending part extends from the first side wall towards a direction away from the first magnetic gap; the lower shell comprises a second bottom wall which covers the third main magnet and a second side wall which extends in a bent manner from a circumferential edge of the second bottom wall towards the first inner magnetic element; and the third extending part extends from the second side wall towards a direction close to the first magnetic gap; the first voice coil vibrates between the first bottom wall and the second main pole plate, and the second voice coil vibrates between the third extending part and the second bottom wall.

Further, the outer diameter of the first main magnet and the outer diameter of the second main magnet are both less than or equal to that of the first main pole plate, and the outer diameter of the third main magnet is less than or equal to the outer diameter of the second main pole plate and greater than that of the first main pole plate.

Further, the first main pole plate and the second main pole plate are both made of magnetically permeable materials.

The technical solution of the second embodiment of the present invention is as follows: a sound device comprises a vibration system, which includes the first voice coil and the second voice coil, wherein the sound device further comprises the above-mentioned dual magnetic circuits structure for driving the vibration system to vibrate.

The present invention has the beneficial effects that the inner magnetic assembly is divided into the first inner magnetic element and the second inner magnetic element which are stacked up, so that the magnetic-circuits structure has the dual magnetic circuits structure. In the design, two magnetic-circuits structures will share one part of the material, so that product consumables are reduced, and the vibration is counteracted; the first magnetic gap is formed between the circumference of the first inner magnetic element and the shell, and the second magnetic gap is formed between the circumference of the second inner magnetic element and the shell; the outer diameter of the second inner magnetic element is set to be greater than that of the first inner magnetic element; the first voice coil is arranged in the first magnetic gap; one part of the second voice coil is arranged in the first magnetic gap, and the other part thereof is arranged in the second magnetic gap, so that the vibration circuits of the first voice coil and the second voice coil are staggered from each other in the vibration directions of the first voice coil and the second voice coil, the height of the dual magnetic circuits structure is reduced, meanwhile in the direction perpendicular to the vibration directions of the first voice coil and the second voice coil, the first voice coil and the second voice coil may be crossed and will not collide with each other. Therefore, compared to the existing dual magnetic circuits structure, the dual magnetic circuits structure provided by the present invention has the advantage that the thickness of the whole dual magnetic circuits structure can be effectively reduced while it is ensured that the vibration spaces and winding heights of the first voice coil and the second voice coil are not changed.

Figure 1:
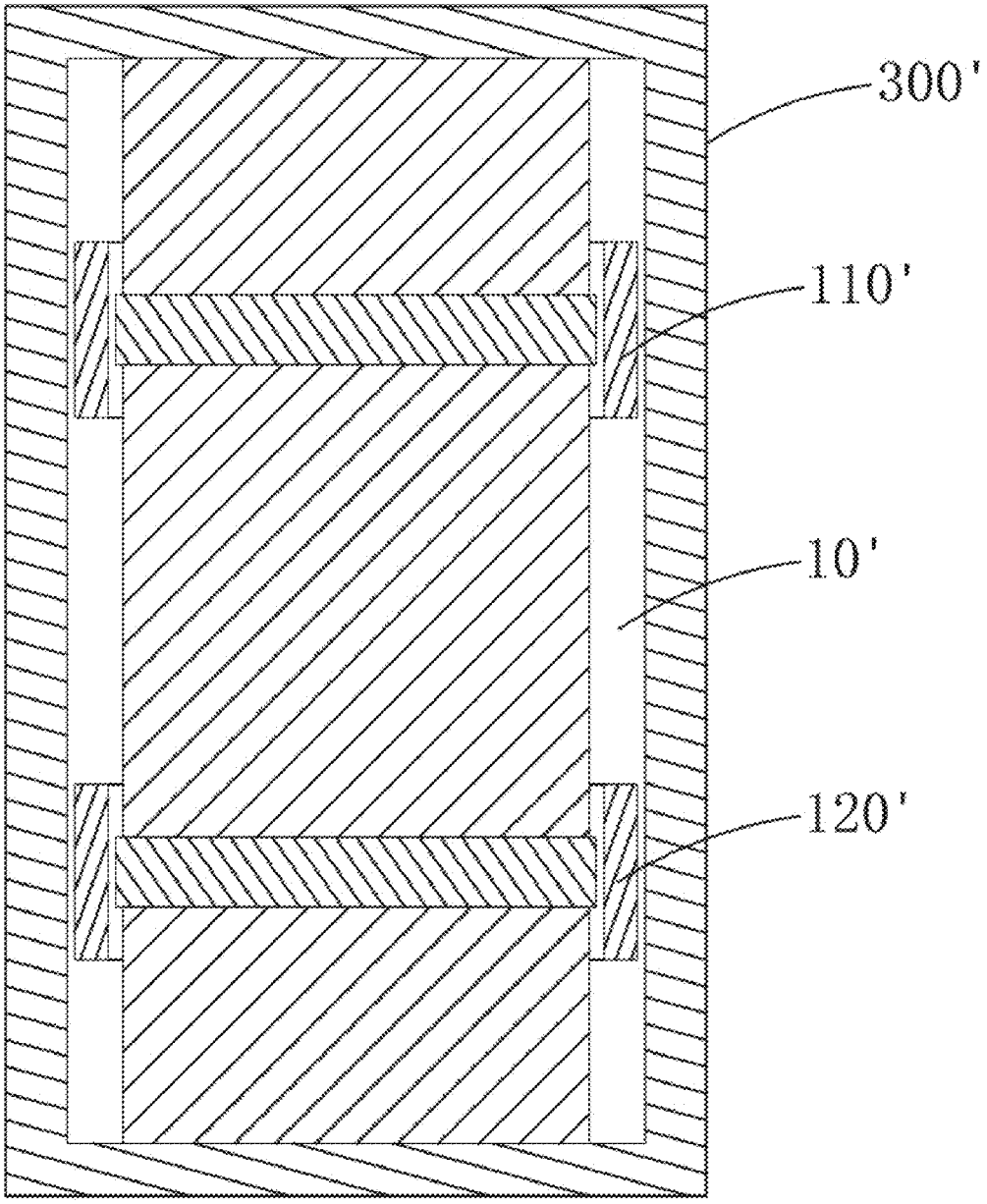
[Related art] FIG. 1
FIG. 1 is a sectional view when an existing dual magnetic circuits structure cooperates with a first voice coil and a second voice coil.
Figure 2:
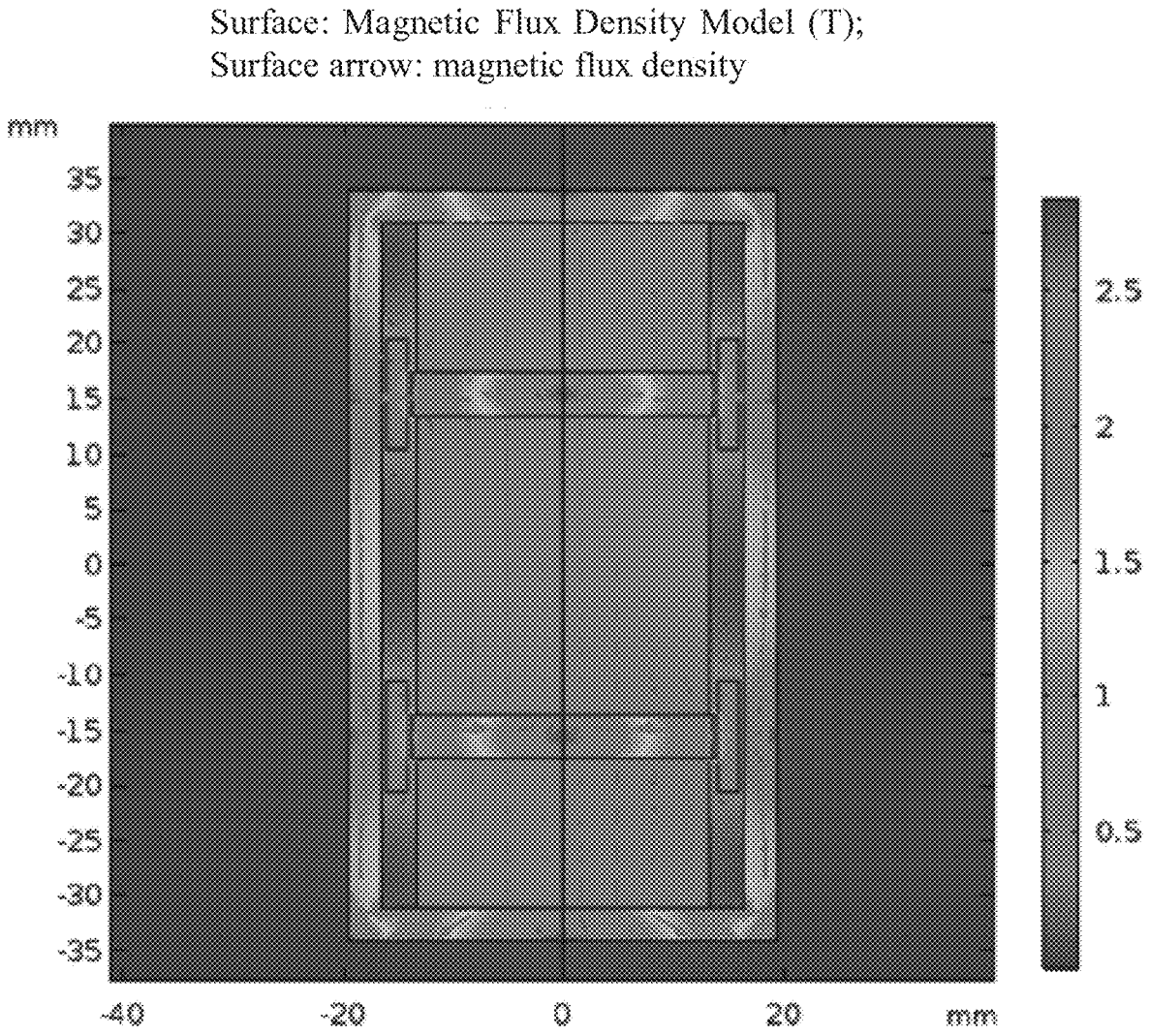
[Related art] FIG. 2
FIG. 2 is a distribution diagram of magnetic lines of an existing dual magnetic circuits structure.

In the drawings: 100: vibration system; 110: first voice coil; 120: second voice coil; 200: dual magnetic circuits structure; 11: first magnetic gap; 12: second magnetic gap; 2: shell; 21: upper shell; 211: first bottom wall; 212: first side wall; 2121: first extending part; 22: lower shell; 221: second bottom wall; 222: second side wall; 2221: third extending part; 23: annular shell; 231: second extending part; 3: inner magnetic assembly; 31: first inner magnetic element; 311: first main magnet; 312: first main pole plate; 313: second main magnet; 32: second inner magnetic element; 321: second main pole plate; 322: third main magnet; 41: first auxiliary magnet; 42: second auxiliary magnet.

DETAILED DESCRIPTION OF THE EMBODIMENTS

The present invention is described in detail below in combination with FIG. 3 to FIG. 6.

Figure 3:
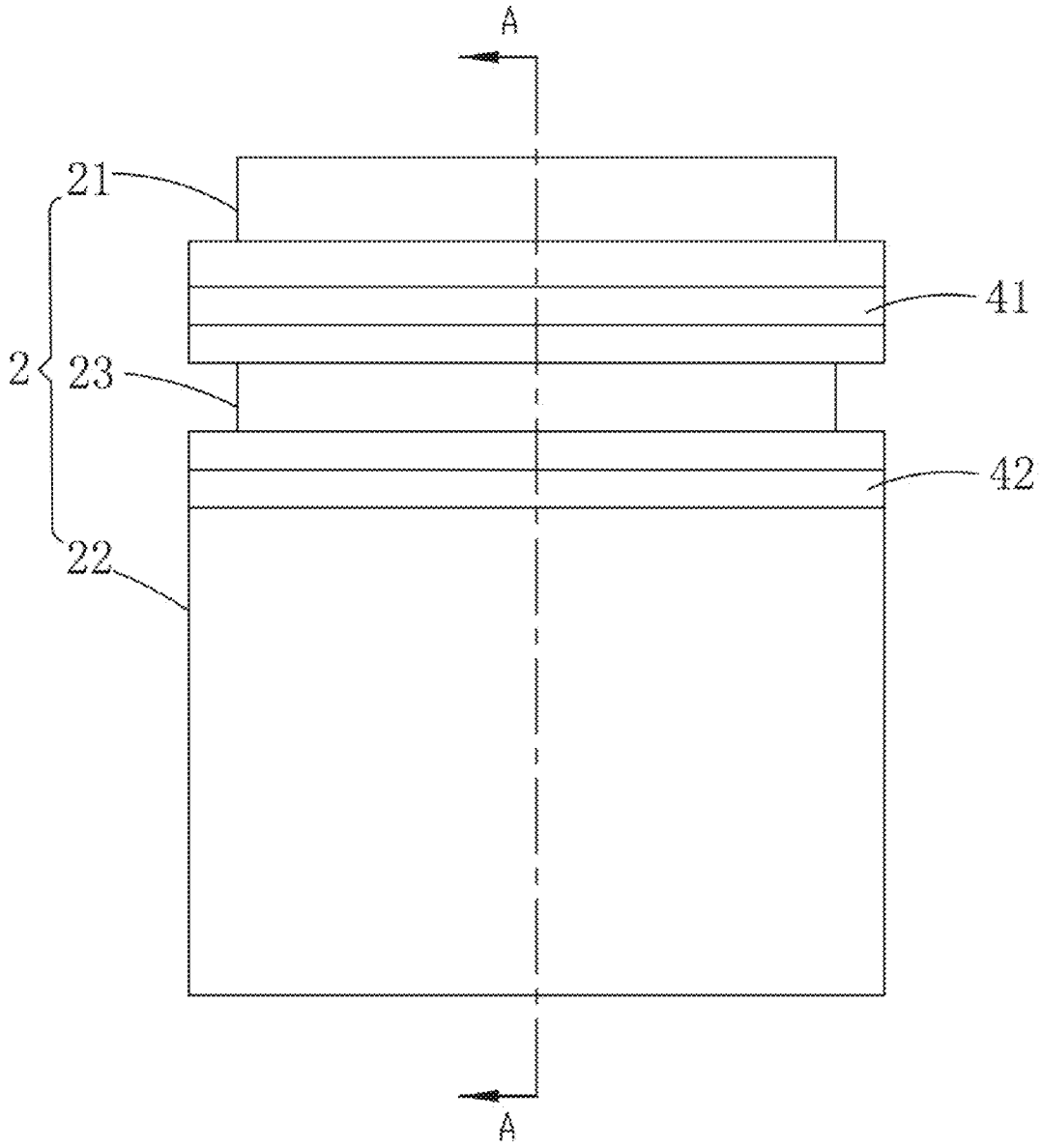
FIG. 3 is a three-dimensional diagram when a dual magnetic circuits structure provided by the embodiments of the present invention cooperates with a first voice coil and a second voice coil.
Figure 4:
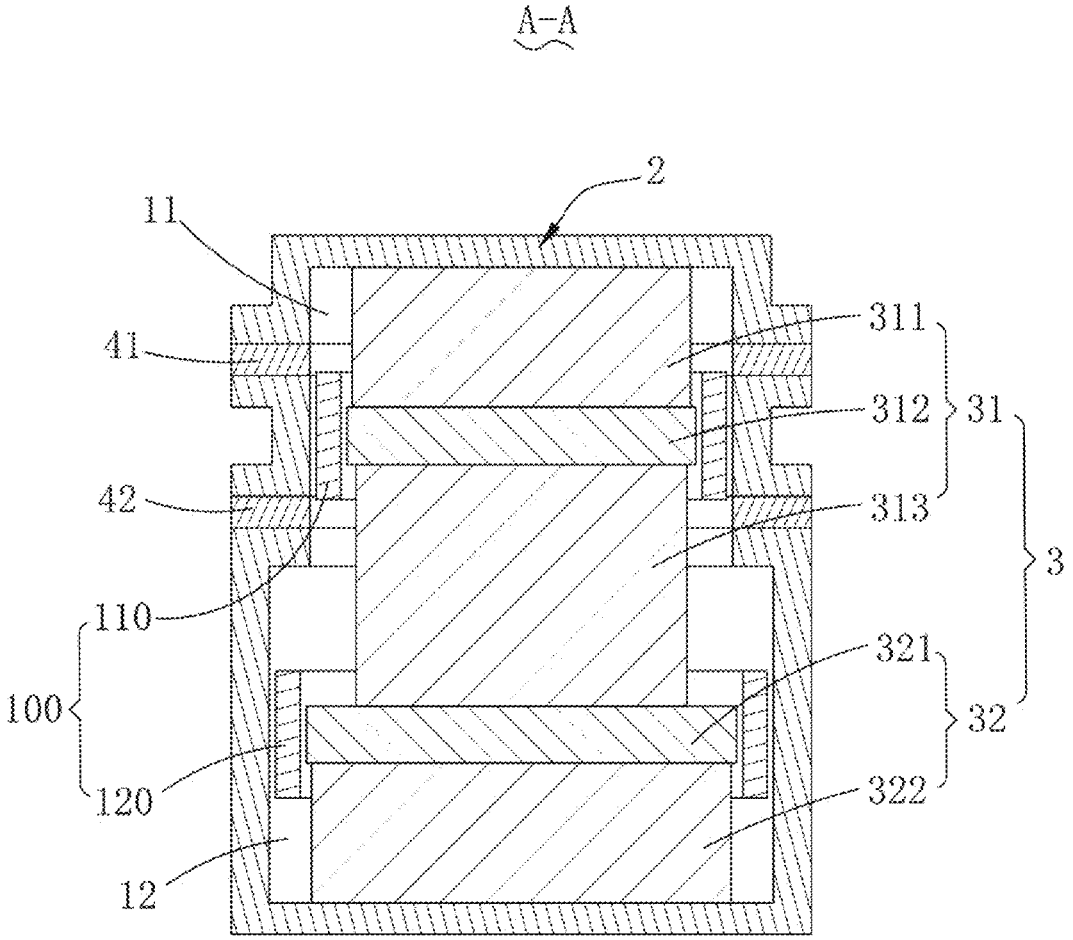
FIG. 4 is a cutaway view of FIG. 3 along the A-A line.
Figure 5:
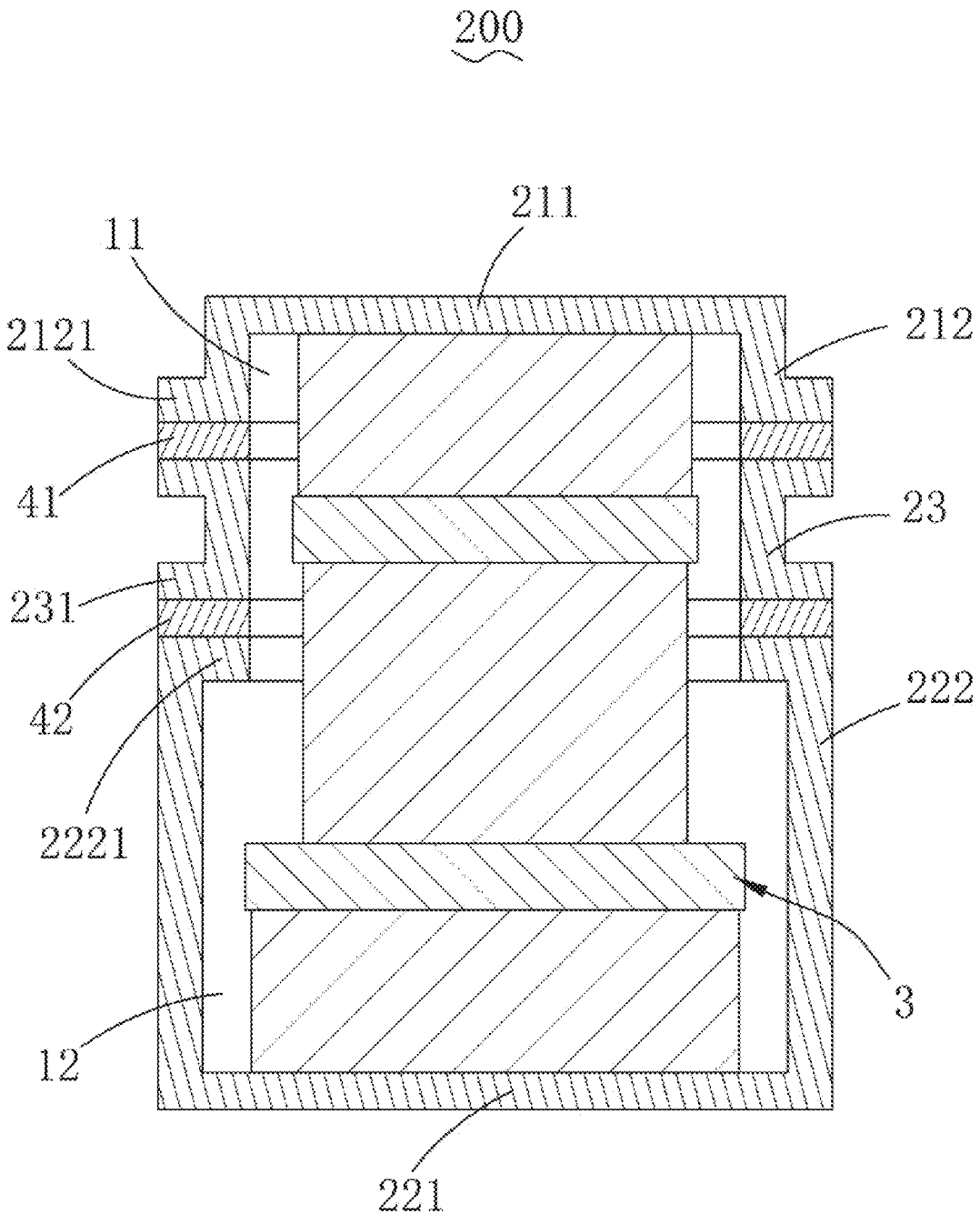
FIG. 5 is a sectional view of a dual magnetic circuits structure provided by the embodiments of the present invention.

Referring to FIG. 3 to FIG. 5, the embodiments of the present invention provide a sound device (not shown) including a vibration system 100 and a dual magnetic circuits structure 200 configured for driving the vibration system 100 to vibrate. The vibration system 100 includes the first voice coil 110 and the second voice coil 120, the dual magnetic circuits structure 200 has a first magnetic gap 11 and a second magnetic gap 12, the first voice coil 110 is arranged in the first magnetic gap 11, one part of the second voice coil 120 is arranged in the first magnetic gap 11, and the other part is arranged in the second magnetic gap 12. Accordingly the vibration paths of the first voice coil 110 and the second voice coil 120 may be staggered from each other in a direction parallel to a vibration direction of the first voice coil 110.

Referring to FIG. 3 to FIG. 5 again, the dual magnetic circuits structure 200 includes a shell 2 and an inner magnetic assembly 3, wherein the shell 2 is made of a magnetically permeable material, the inner magnetic assembly 3 is arranged in the shell 2 and includes a first inner magnetic element 31 and a second inner magnetic element 32 which are stacked up. The first magnetic gap 11 configured for disposing the first voice coil 110 and part of the second voice coil 120 is formed in a gap between a circumference of the first inner magnetic element 31 and the shell 2, and the second magnetic gap 12 configured for disposing the other part of the second voice coil 120 is formed in a gap between the circumference of the second inner magnetic element 32 and the shell 2. The outer diameter of the second inner magnetic element 32 is greater than that of the first inner magnetic element 31 so that the vibration paths of the first voice coil 110 and the second voice coil 120 are staggered from each other in the direction parallel to the vibration direction of the first voice coil 110. The inner magnetic assembly 3 is divided into the first inner magnetic element 31 and the second inner magnetic element 32 which are stacked up, so that the magnetic-circuits structure has the dual magnetic circuits structure 200, accordingly the first inner magnetic element 31 and the second inner magnetic element 32 may share one part of the material, reducing product consumables and counteracting the vibration. The first magnetic gap 11 is formed in the gap between the circumference of the first inner magnetic element 31 and the shell 2, and the second magnetic gap 12 is formed in the gap between the circumference of the second inner magnetic element 32 and the shell 2. The outer diameter of the second inner magnetic element 32 is set to be greater than that of the first inner magnetic element 31; the first voice coil 110 is arranged in the first magnetic gap 11; one part of the second voice coil 120 is arranged in the first magnetic gap 11, and the other part is arranged in the second magnetic gap 12, so that the vibration paths of the first voice coil 110 and the second voice coil 120 are staggered from each other in the direction parallel to the vibration direction of the first voice coil 110. In the direction perpendicular to the vibration directions of the first voice coil 110 and the second voice coil 120, the first voice coil 110 and the second voice coil 120 may be crossed and will not collide with each other while the height of the dual magnetic circuits structure 200 is reduced. Therefore, in the dual magnetic circuits structure 200 provided by the present invention, the thickness of the whole dual magnetic circuits structure 200 can be effectively reduced while it is ensured that the vibration spaces and winding heights of the first voice coil 110 and the second voice coil 120 are not changed. In the present embodiment, the shell 2 forms the first magnetic gap 11 and the second magnetic gap 12 respectively with the first inner magnetic element 31 and the second inner magnetic element 32, and also plays a role of fixing the first inner magnetic element 31 and the second inner magnetic element 32.

Referring to FIG. 4, the first inner magnetic element 31 includes the first main magnet 311, the first main pole plate 312, and the second main magnet 313 which are stacked up in sequence; the first magnetic gap 11 is formed between the circumference of the first main magnet 311, the circumference of the first main pole plate 312 as well as the circumference of the second main magnet 313 and the shell 2. The second inner magnetic element 32 includes the second main pole plate 321 and the third main magnet 322; the second main pole plate 321 is arranged between the second main magnet 313 and the third main magnet 322; an outer diameter of the second main pole plate 321 is greater than that of the first main pole plate 312; the second magnetic gap 12 is formed between the circumference of the second main pole plate 321 as well as the circumference of the third main magnet 322 and the shell 2 form; and the first magnetic gap 11 and the second magnetic gap 12 communicate with each other. In the present embodiment, the outer diameter of the second main pole plate 321 is greater than that of the first main pole plate 312; the first voice coil 110 is arranged in the first magnetic gap 11; and part of the second voice coil 120 is arranged in the first magnetic gap 11, and part of the second voice coil is arranged in the second magnetic gap 12. Therefore, the vibration paths of the first voice coil 110 and the second voice coil 120 are staggered from each other. The vibration spaces and the winding heights of the first voice coil 110 and the second voice coil 120 will not be affected while the thickness of the second main magnet 313 shared by the dual magnetic circuits structure 200 is reduced. Therefore, the height of the dual magnetic circuits structure 200 can be effectively reduced while it is ensured that the vibration spaces and the winding heights of the first voice coil 110 and the second voice coil 120 are not changed.

Preferably, the first main magnet 311, the second main magnet 313, and the third main magnet 322 are made of permanent magnet materials. The permanent magnet materials used may be one or more of AlNiCo permanent magnet alloy, FeCrCo permanent magnet alloy, a permanent magnetic ferrite, or a rare earth permanent magnetic material.

Preferably, the shell 2 includes an upper shell 21, a lower shell 22 opposite to the upper shell 21, and a annular shell 23 for connecting the upper shell 21 with the lower shell 22. The upper shell 21 is arranged on a side of the first main magnet 311 away from the first main pole plate 312. The lower shell 22 is arranged on a side of the third main magnet 322 away from the second main pole plate 321. The annular shell 23 surrounds the first main pole plate 312. Referring to FIG. 3 to FIG. 5 again, a first auxiliary magnet 41 is clamped between the upper shell 21 and the annular shell 23. The first auxiliary magnet 41 circumferentially surrounds the first main magnet 311. A second auxiliary magnet 42 is clamped between the annular shell 23 and the lower shell 22. The second auxiliary magnet 42 circumferentially surrounds the second main magnet 313. By the arrangement of the first auxiliary magnet 41 and the second auxiliary magnet 42, it is conductive for improving the BL of the first voice coil 110.

Preferably, the first auxiliary magnet 41 and the second auxiliary magnet 42 are made of permanent magnet materials. The permanent magnet materials used may be one or more of the AlNiCo permanent magnet alloy, the FeCrCo permanent magnet alloy, the permanent magnetic ferrite, or the rare earth permanent magnetic material.

Referring to FIG. 3 to FIG. 5 again, an end part of the upper shell 21 close to the annular shell 23 extends towards a direction away from the first magnetic gap 11 to form a first extending part 2121. Two end parts of the annular shell 23 extend towards the direction away from the first magnetic gap 11 to form two second extending parts 231. An end part of the lower shell 22 close to the annular shell 23 extends towards a direction close to the first magnetic gap 11 to form a third extending part 2221. The first auxiliary magnet 41 is clamped between the first extending part 2121 and one of the second extending parts 231, and the second auxiliary magnet 42 is clamped between the third extending part 2221 and the other second extending part 231. By the arrangement of the first extending part 2121, the second extending parts 231, and the third extending part 2221, the stabilities of the first auxiliary magnet 41 and the second auxiliary magnet 42 are improved. In the present embodiment, the inner diameter of the first auxiliary magnet 41, the inner diameter of the second auxiliary magnet 42, the inner diameter of the first extending part 2121, the inner diameters of the second extending parts 231, and the inner diameter of the third extending part 2221 are the same, and the outer diameter of the first auxiliary magnet 41, the outer diameter of the second auxiliary magnet 42, the outer diameter of the first extending part 2121, the outer diameters of the second extending parts 231, and the outer diameter of the third extending part 2221 are the same, so that the widths of the first auxiliary magnet 41 and the second auxiliary magnet 42 are effectively increased. That is, along the direction perpendicular to the vibration direction of the first voice coil 110, the lengths of the first auxiliary magnet 41 and the second auxiliary magnet 42 are increased, and the BL of the first voice coil 110 can be further improved. Of course, in other embodiments, the thicknesses of the first auxiliary magnet 41 and the second auxiliary magnet 42 are increased. That is, along the direction parallel to the vibration direction of the first voice coil 110, the lengths of the first auxiliary magnet 41 and the second auxiliary magnet 42 are increased, and the BL of the first voice coil 110 can also be effectively improved.

Preferably, the first main pole plate 312, the second main pole plate 321, the annular shell 23, the upper shell 21, and the lower shell 22 are all made of magnetically permeable materials. In the present embodiment, the first main pole plate 312, the second main pole plate 321, the annular shell 23, the upper shell 21, and the lower shell 22 are all made of soft magnets.

Referring to FIG. 3 to FIG. 5, the upper shell 21 includes a first bottom wall 211 which covers the first main magnet 311, and a first side wall 212 which extends in a bent manner from a circumferential edge of the first bottom wall 211 towards the second inner magnetic element 32; and the first extending part 2121 extends from the first side wall 212 towards a direction away from the first magnetic gap 11. The lower shell 22 includes a second bottom wall 221 which covers the third main magnet 322 and a second side wall 222 which extends in a bent manner from a circumferential edge of the second bottom wall 221 towards the first inner magnetic element 31; and the third extending part 2221 extends from the second side wall 222 towards a direction close to the first magnetic gap 11. The first voice coil 110 vibrates between the first bottom wall 211 and the second main pole plate 321, and the second voice coil 120 vibrates between the third extending part 2221 and the second bottom wall 221. By such arrangement mode, the first voice coil 110 and the second voice coil 120 may be crossed with each other in the direction perpendicular to the vibration direction of the first voice coil 110 when they vibrate between the third extending part 2221 and the second main pole plate 321.

Further, the outer diameter of the first main magnet 311 and the outer diameter of the second main magnet 313 are both less than or equal to the outer diameter of the first main pole plate 312, and the outer diameter of the third main magnet 322 is less than or equal to the outer diameter of the second main pole plate 321 and greater than the outer diameter of the first main pole plate 312. By such design mode, the influence on the BL of the second voice coil 120 can be reduced by means of increasing the outer diameter of the third main magnet 322 while the height of the third main magnet 322 is reduced.

Figure 6:
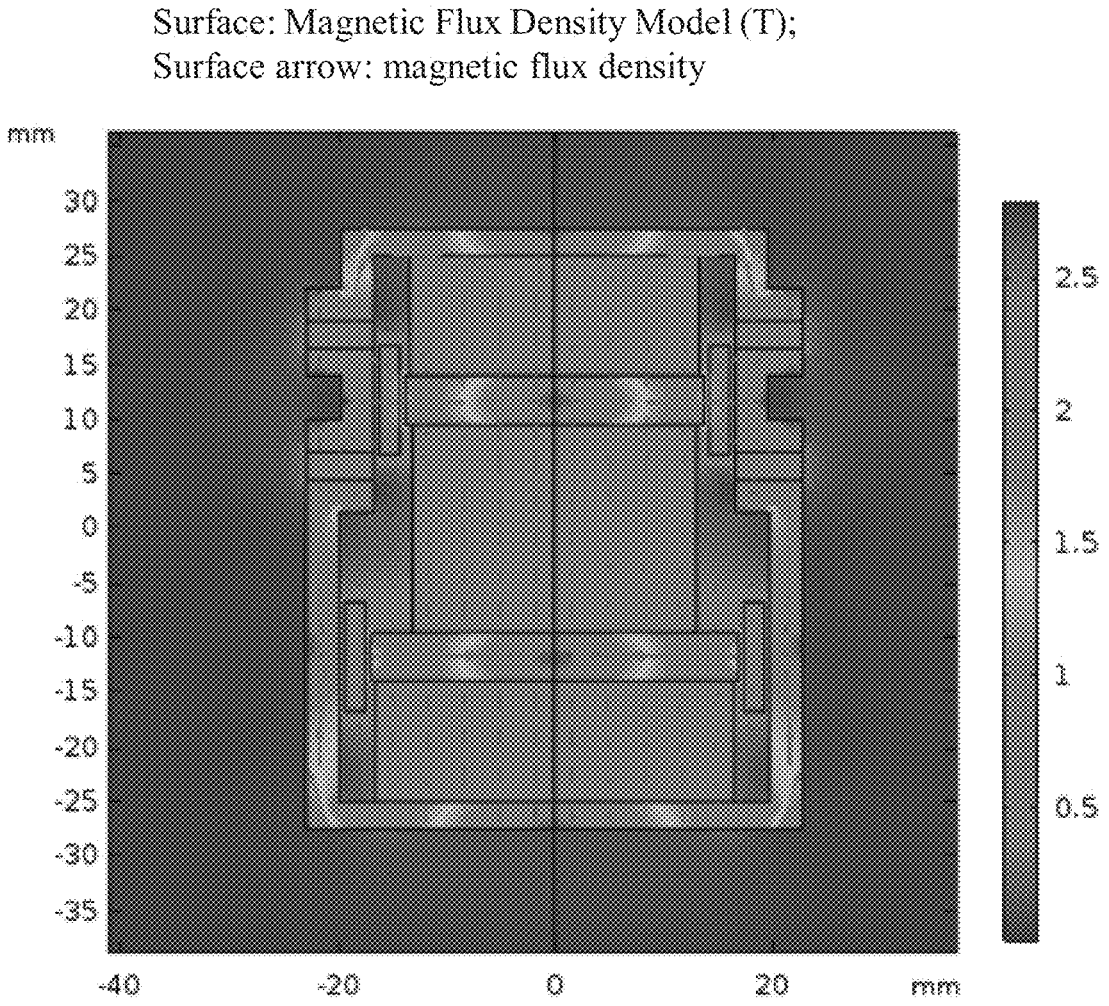
FIG. 6 is a distribution diagram of magnetic lines of a dual magnetic circuits structure provided by the embodiments of the present invention.

In one embodiment, a permanent magnet material with a volume of 29-30 $cm^3$ is used to prepare the first main magnet 311, the second main magnet 313, the third main magnet 322, the first auxiliary magnet 41, and the second auxiliary magnet 42. The height of the dual magnetic circuits structure 200 is 50-60 mm. In particular, the height of the dual magnetic circuits structure 200 manufactured by the permanent magnet material with the volume of 29.4 $cm^3$ is 55 mm. Meanwhile, the BL of the first voice coil 110 and the second voice coil 120 is 13.8 Wb/m in total. FIG. 6 is a distribution diagram of magnetic lines of the dual magnetic circuits structure 200 provided by the embodiments of the present invention. Compared with the existing dual magnetic circuits structure manufactured by the permanent magnet material of 30 cm3, this dual magnetic circuits structure has the advantage that the overall height is reduced by 19% (from 68 mm decreased to 55 mm) while it is ensured that the vibration spaces and the winding heights of the first voice coil 110 and the second voice coil 120 are not changed, and the BL of the first voice coil 110 and the second voice coil 120 is improved by 6% in total (from 12.9 Wb/m increased to 13.8 Wb/m). Therefore, in the dual magnetic circuits structure 200 provided by the embodiments of the present invention, the overall height can be effectively reduced without changing the vibration spaces and the winding heights of the first voice coil 110 and the second voice coil 120.

The embodiments of the present invention are described above only. It should be noted that those of ordinary skill in the art can further make improvements without departing from the concept of the present invention. These improvements shall all fall within the protection scope of the present invention.

What is claimed is:

1. A dual magnetic circuits structure, comprising a shell and an inner magnetic assembly, wherein the shell is made of a magnetically permeable material; the inner magnetic assembly is arranged in the shell;

wherein the inner magnetic assembly comprises a first inner magnetic element and a second inner magnetic element which are stacked up;

a first magnetic gap configured for disposing a first voice coil and part of a second voice coil is formed in a gap between a circumference of the first inner magnetic element and the shell;

a second magnetic gap configured for disposing the other part of the second voice coil is formed in a gap between the circumference of the second inner magnetic element and the shell in a spacing manner;

the second inner magnetic element has an outer diameter greater than that of the first inner magnetic element so that vibration paths of the first voice coil and the second voice coil are staggered from each other in a direction parallel to a vibration direction of the first voice coil wherein the first inner magnetic element comprises a first main magnet, a first main pole plate, and a second main magnet which are stacked up in sequence; the first magnetic gap is formed between the circumference of the first main magnet, the circumference of the first main pole plate as well as the circumference of the second main magnet and the shell; the second inner magnetic element comprises a second main pole plate and a third main magnet the second main pole plate is arranged between the second main magnet and the third main magnet the second magnetic gap is formed between the circumference of the second main pole plate as well as the circumference of the third main magnet and the shell; wherein the shell comprises an upper shell, a lower shell opposite to the upper shell, and a annular shell for connecting the upper shell with the lower shell; the upper shell is arranged on a side of the first main magnet away from the first main pole plate; the lower shell is arranged on a side of the third main magnet away from the second main pole plate; and the annular shell surrounds the first main pole plate.

2. The dual magnetic circuits structure of claim 1, wherein the second main pole plate has an outer diameter greater than that of the first main pole plate;

and the first magnetic gap and the second magnetic gap communicate with each other.

3. The dual magnetic circuits structure of claim 2, wherein a first auxiliary magnet is clamped between the upper shell and the annular shell; the first auxiliary magnet circumferentially surrounds the first main magnet; a second auxiliary magnet is clamped between the annular shell and the lower shell; and the second auxiliary magnet circumferentially surrounds the second main magnet.

4. The dual magnetic circuits structure of claim 3, wherein an end part of the upper shell close to the annular shell extends towards a direction away from the first magnetic gap to form a first extending part; two end parts of the annular shell extend towards the direction away from the first magnetic gap to form two second extending parts; an end part of the lower shell close to the annular shell extends towards a direction close to the first magnetic gap to form a third extending part;

the first auxiliary magnet is clamped between the first extending part and one of the second extending parts, and the second auxiliary magnet is clamped between the third extending part and the other second extending part.

5. The dual magnetic circuits structure of claim 4, wherein the upper shell comprises a first bottom wall which covers the first main magnet, and a first side wall which extends in a bent manner from a circumferential edge of the first bottom wall towards the second inner magnetic element; the first extending part extends from the first side wall towards a direction away from the first magnetic gap; the lower shell comprises a second bottom wall which covers the third main magnet and a second side wall which extends in a bent manner from a circumferential edge of the second bottom wall towards the first inner magnetic element; the third extending part extends from the second side wall towards a direction close to the first magnetic gap; the first voice coil vibrates between the first bottom wall and the second main pole plate; and the second voice coil vibrates between the third extending part and the second bottom wall.

6. The dual magnetic circuits structure of claim 2, wherein the outer diameter of the first main magnet and the outer diameter of the second main magnet are both less than or equal to that of the first main pole plate, and the outer diameter of the third main magnet is less than or equal to the outer diameter of the second main pole plate and greater than that of the first main pole plate.

7. The dual magnetic circuits structure of claim 2, wherein the first main pole plate and the second main pole plate are both made of magnetically permeable materials.

8. A sound device comprising a vibration system, wherein the vibration system comprises a first voice coil and a second voice coil; and the sound device further comprises the dual magnetic circuits structure of claim 1 for driving the vibration system to vibrate.

* * * * *